US007880645B2

(12) United States Patent
Park

(10) Patent No.: US 7,880,645 B2
(45) Date of Patent: Feb. 1, 2011

(54) METHOD AND APPARATUS FOR PROVIDING AND USING PUBLIC TRANSPORTATION INFORMATION CONTAINING BUS STOP-CONNECTED INFORMATION

(75) Inventor: Jun Hyung Park, Pyeongtaeki-si (KR)

(73) Assignee: LG Electronics Inc., Seoul (KR)

( * ) Notice: Subject to any disclaimer, the term of this patent is extended or adjusted under 35 U.S.C. 154(b) by 251 days.

(21) Appl. No.: 11/831,681

(22) Filed: Jul. 31, 2007

(65) Prior Publication Data

US 2008/0030379 A1 Feb. 7, 2008

(30) Foreign Application Priority Data

Aug. 4, 2006 (KR) ..... 10-2006-0073626

(51) Int. Cl.
*G08G 1/123* (2006.01)

(52) U.S. Cl. ..... 340/994; 340/989

(58) Field of Classification Search ..... 340/944, 340/989, 988

See application file for complete search history.

(56) References Cited

U.S. PATENT DOCUMENTS

| | | | | |
|---|---|---|---|---|
| 3,886,515 | A | 5/1975 | Cottin et al. | |
| 4,713,661 | A | 12/1987 | Boone et al. | |
| 4,791,571 | A * | 12/1988 | Takahashi et al. | 701/117 |
| 5,168,451 | A | 12/1992 | Bolger | |
| 5,736,940 | A | 4/1998 | Burgener | |
| 5,799,263 | A | 8/1998 | Culbertson | |
| 6,037,881 | A | 3/2000 | Bornhauser et al. | |
| 6,456,207 | B1 | 9/2002 | Yen | |
| 6,803,862 | B2 | 10/2004 | O'Connor et al. | |
| 6,975,248 | B2 | 12/2005 | Asari et al. | |
| 7,646,774 | B2 | 1/2010 | Kim et al. | |
| 2002/0011940 | A1 | 1/2002 | Cappel | |
| 2002/0099500 | A1 * | 7/2002 | Schmier et al. | 701/200 |
| 2003/0137435 | A1 | 7/2003 | Haddad et al. | |
| 2006/0074545 | A1 | 4/2006 | Kim | |
| 2006/0106536 | A1 | 5/2006 | Park | |
| 2006/0267794 | A1 * | 11/2006 | Lee et al. | 340/905 |

FOREIGN PATENT DOCUMENTS

| | | | |
|---|---|---|---|
| JP | 2002-251697 | A | 9/2002 |
| JP | 2002-269679 | A | 9/2002 |
| JP | 2002-324299 | A | 11/2002 |
| JP | 2004-15743 | A | 1/2004 |
| JP | 2004-288030 | A | 10/2004 |
| JP | 2005-091211 | A | 4/2005 |
| KR | 10-2003-0096115 | A | 12/2003 |
| KR | 10-2005-0060719 | A | 6/2005 |

(Continued)

*Primary Examiner*—Travis R Hunnings
(74) *Attorney, Agent, or Firm*—Birch, Stewart, Kolasch & Birch, LLP

(57) ABSTRACT

A method and apparatus for providing public transportation information and using the provided information, are discussed. When creating information on each bus stop such as the bus stop ID and a distance between bus stops, a method for encoding transportation information in accordance with an embodiment creates information on nearby subway stations accessible on foot and/or nearby bus stops located on bus routes (or bus lines) that do not pass the bus stop as well, and constructs status information containing the created information. One or more messages containing the status information can be transmitted wirelessly.

21 Claims, 13 Drawing Sheets

FOREIGN PATENT DOCUMENTS

| | | | | |
|---|---|---|---|---|
| KR | 1020050078013 | A | * | 6/2005 |
| KR | 10-2005-0078013 | A | | 8/2005 |
| KR | 10-2006-0002468 | A | | 1/2006 |
| KR | 1020060002468 | A | * | 1/2006 |
| KR | 10-2006-0044074 | A | | 5/2006 |
| KR | 10-2006-0063617 | A | | 6/2006 |
| KR | 10-2006-0070831 | A | | 6/2006 |
| KR | 10-2006-0082954 | A | | 7/2006 |

* cited by examiner

FIG. 3

301

```
<bus_service_message>:=
<intunli>(mid),                          : Message ID
<intunli>(ver),                          : Version Number
<intunli>                                : Number of bytes following the length indicator
<bitswitch>(selector),                   : Message elements supplied
if(selector = xxxxxxx1) <time_t>,        : Message generation time
if(selector = xxxxxx1x) <time_t>,        : unused (Reserved for future use)
if(selector = xxxxx1xx) <time_t>,        : unused (Reserved for future use)
if(selector = xxxx1xxx) <time_t>,        : unused (Reserved for future use)
if(selector = xxx1xxxx) <bsi01>,         : unused (Reserved for future use)
if(selector = xx1xxxxx) <intunlo>,       : unused (Reserved for future use)
if(selector = x1xxxxxx) <bsi02>,         : unused (Reserved for future use)
if(selector = 1xxxxxxx) <bsi_components>: Bus service information message components
```

FIG. 4

```
<bsi_components >:=
<intunti>(n),                 : Number of components
n*<bsi_component()>;          : Bus service information message component
```

```
<bsi_component(x) >:=         : Bus Service Information template
<intunti>(id),                : Identifier, id=x hex
<intunli>(n),                 : Length, n, of component data in bytes
n*<byte>;                     : Component data
```

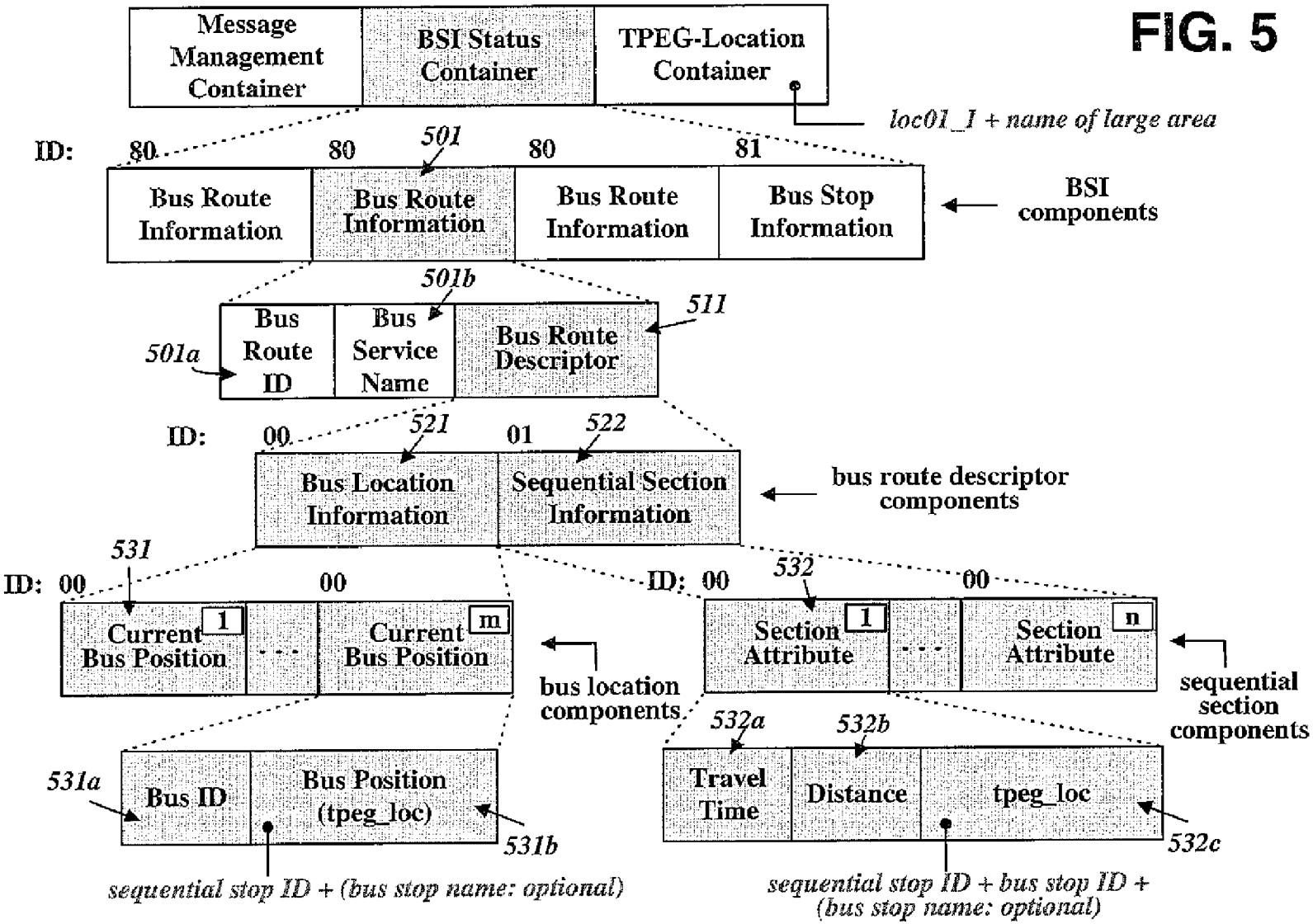
FIG. 5
Message Management Container
BSI Status Container
TPEG-Location Container
loc01_I + name of large area
BSI components
ID:
80
Bus Route Information
80
Bus Route Information
501
Bus Route Information
80
Bus Stop Information
81
501a
Bus Route ID
Bus Service Name
501b
Bus Route Descriptor
511
bus route descriptor components
ID:
00
Bus Location Information
521
01
Sequential Section Information
522
ID:
00
Current Bus Position
1
Current Bus Position
m
531
00
bus location components
ID:
00
Section Attribute
1
Section Attribute
n
532
00
sequential section components
531a
Bus ID
Bus Position (tpeg_loc)
531b
sequential stop ID + (bus stop name: optional)
532a
Travel Time
Distance
532b
tpeg_loc
532c
sequential stop ID + bus stop ID + (bus stop name: optional)

FIG. 6A

```
<bsi_component(80) >:=      : Bus Route Information
<intunti>(id),              : Identifier, id=80 hex
<intunli>(n),               : Length, n, of component data in bytes
<intunti>,                  : Bus route ID
<short_string>,             : Bus service name
m*<bus_route_descriptor_component()>;   : Bus route descriptor components
```

FIG. 6B

```
< bus_route_descriptor_component(00) >:= : Bus location information
<intunti>(id),              : Identifier, id=00 hex
<intunli>(n),               : Length, n, of component data in bytes
<intunti>(m),               : Number of bus location
m*<bus_location_component()>; : Bus location component
```

FIG. 6C

```
< bus_location_component(00) >:=          : Current bus position
<intunti>(id),              : Identifier, id=00 hex
<intunli>(n),               : Length, n, of component data in bytes
<intunti>,                  : bus ID
<tpeg_loc_container>;       : TPEG Location container (see Figs. 7A and 7B)
```

FIG. 6D

```
< bus_route_descriptor_component(01) >:= : Sequential section information
<intunti>(id),              : Identifier, id=01 hex
<intunli>(n),               : Length, n, of component data in bytes
<intunti>m,                 : Number of bus location information
m *< sequential_section_information()>;   : sequential section information
```

FIG. 6E

```
< sequential_section_component(00) >:=     : Section attribute
<intunti>(id),              : Identifier, id=00 hex
<intunli>(n),               : Length, n, of component data in bytes
<intunti>,                  : travel time (in minute)
<intunti>,                  : distance (in meter)
<tpeg_location_container>;:TPEG Location container (see Figs. 7A and 7B)
```

FIG. 9A

```
<bsi_component(81) >:=              : Bus stop Information
<intunti>(id),                      : Identifier, id=81 hex
<intunli>(n),                       : Length, n, of component data in bytes
m*< bus_stop_descriptor_component()>;    : Bus stop descriptor components
```

FIG. 9B

```
< bus_stop_descriptor_component(00) >:=   : Bus stop location
<intunti>(id),                  : Identifier, id=00 hex
<intunli>(n),                   : Length, n, of component data in bytes
<tpeg_location_container>;: TPEG Location container (see Figs. 7A and 7B)
```

FIG. 9C

```
< bus_stop_descriptor_component(01) >:=   : Arrival bus
<intunti>(id),                  : Identifier, id=01 hex
<intunli>(n),                   : Length, n, of component data in bytes
<intunti>(m),                   : Number of arrival buses
m*<arrival_bus_component()>;  : Arrival bus component
```

FIG. 9D

```
< arrival_bus_component(00) >:=: Arrival bus attribute
<intunti>(id),                  : Identifier, id=00 hex
<intunli>(n),                   : Length, n, of component data in bytes
<intunti>,                      : Bus route ID
<short_string>,                 : Bus service name
<intunti>,                      : Predicted arrival time
<intunti>,                      : bus ID
<tpeg_location_container>;: TPEG Location container (see Figs. 7A and 7B)
```

FIG. 10

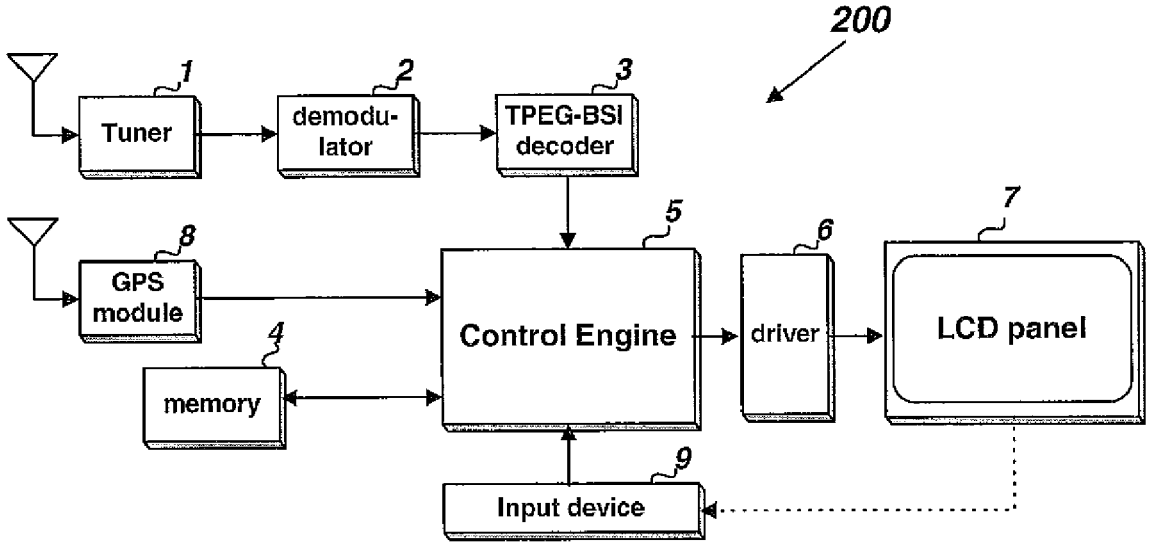

FIG. 11A

| route (line) ID | bus stop ID | sequential stop ID | traveling time on section (min.) | current bus location |
|---|---|---|---|---|
| B504 | Guro Industrial Complex | 1 | 3 | No |
| B504 | Gasan Elementary Sch. | 2 | 4 | Yes |
| ⋮ | ⋮ | ⋮ | ⋮ | ⋮ |
| R9404 | Ori Subway Station | 1 | 5 | No |
| ⋮ | ⋮ | ⋮ | ⋮ | ⋮ |

FIG. 11B

| bus stop ID | route (line) ID | predicted arrival time | current bus location |
|---|---|---|---|
| 5-corners of industrial complex | B504 | 2:06PM | Guro Industrial Complex |
| 5-corners of industrial complex | G5528 | 2:01PM | Gasan Elementary Sch. |
| ⋮ | ⋮ | ⋮ | ⋮ |
| Gangnam Subway Station | R9404 | 2:08PM | Seohyeon Subway Station |
| ⋮ | ⋮ | ⋮ | ⋮ |

FIG. 11C

| bus stop ID | nearby station ID for transfer | route (line) ID | ID of nearby bus stop | distance (m) |
|---|---|---|---|---|
| AA | Line-2, Guro Digital Industrial Complex | - | - | - |
| | - | G5413 | southern police station | 450 |
| | - | B651 | southern police station | 450 |
| BB | Line-3, Dogok | - | - | - |
| | Line-Bundang, Dogok | - | - | - |
| | ⋮ | ⋮ | ⋮ | ⋮ |
| ⋮ | ⋮ | ⋮ | ⋮ | ⋮ |

METHOD AND APPARATUS FOR PROVIDING AND USING PUBLIC TRANSPORTATION INFORMATION CONTAINING BUS STOP-CONNECTED INFORMATION

This application claims the priority benefit of the Korean Patent Application No. 10-2006-0073626 filed on Aug. 4, 2006, which is hereby incorporated by reference.

BACKGROUND OF THE INVENTION

1. Field of the Invention

The present invention relates to a method and apparatus for providing public transportation information and using the provided information.

2. Background of the Related Art

With the advancement in digital signal processing and communication technologies, radio and TV broadcasts are in the process of being digitalized. Digital broadcast can provide various types of additional information (e.g., news, stock, weather, traffic information, etc.) as well as audio and video contents.

Due to the increase in the number of vehicles in downtown areas and highways, traffic congestions take place frequently, which results in environmental pollution. To reduce traffic congestions and environmental pollution, the use of public transportation is encouraged. To promote the use of public transportation effectively, it should be guaranteed that public transportation is convenient and predictable. In the case of bus service, one of the major public transportation, it is necessary to provide information on each bus route (or bus line) and changes in bus travel time depending on traffic volume.

Public transportation information requires a standard format because digital public transportation information should be received and interpreted in the same way by various terminals made by different manufacturers.

SUMMARY OF THE INVENTION

It is one object of the present invention to provide public transportation information so that users can obtain a time table of buses available at any bus stop.

It is another object of the present invention to provide public transportation information so that users can use alternative bus lines or other transportation means at any bus stop.

It is another object of the present invention to provide a method and apparatus for providing public transportation information, which address the limitations associated with the related art.

A method for encoding transportation information in accordance with one embodiment of the invention creates information on each of bus stops located on a bus route (or bus line), information on a nearby station and/or bus stop available for transfer from each of the bus stops, and information on the position of each bus running on the bus route, and creates status information containing the created information, the status information being stored in a message.

A method for encoding transportation information in accordance with another embodiment of the invention creates information on a bus stop, information on a nearby station and/or bus stop available for transfer from the bus stop, and information on the arrival time of each bus passing the bus stop, and creates status information containing the created information, the status information being stored in a message.

A method for decoding transportation information in accordance with one embodiment of the invention extracts status information from a received signal and extracts information on each of bus stops located on a bus route, information on a nearby station and/ort bus stop available for transfer from each of the bus stops, and information on the position of each bus running on the bus route from the extracted status information.

A method for decoding transportation information in accordance with another embodiment of the invention extracts status information from a received signal and extracts information on a bus stop, information on a nearby station and/or bus stop available for transfer from the bus stop, and information on the arrival time of each bus passing the bus stop from the extracted status information.

In one embodiment according to the invention, the information on a nearby station available for transfer from a bus stop comprises information for identifying the station and the distance between the station and the bus stop.

In one embodiment according to the invention, the information on a nearby bus stop available for transfer from a bus stop comprises information for identifying the nearby bus stop, the distance between the nearby bus stop and the bus stop, and information for identifying bus routes passing the nearby bus stop.

An apparatus for decoding transportation information in accordance with one embodiment of the invention comprises a demodulator for demodulating a received signal thereby outputting a sequence of messages containing public transportation information, a decoder for extracting status information from each of the messages and for extracting public transportation information containing information on each of bus stops located on a bus route, information on a nearby station and/or bus stop available for transfer from each of the bus stops, and information on the position of each bus running on the bus route from the extracted status information, or for extracting public transportation information containing information on a bus stop, information on a nearby station and/or bus stop available for transfer from the bus stop, and information on the arrival time of each bus passing the bus stop from the extracted status information, and a control unit for storing the extracted information in a storage unit and for outputting the stored information or a part of the stored information via an output unit depending on a condition.

An apparatus for providing transportation information in accordance with one embodiment of the invention comprises a decoder for extracting information on a bus stop and information on a nearby station and/or bus stop available for transfer from the bus stop from a received signal; a control unit, responsive to the user's request, for outputting the extracted information via an output unit; and an interface unit to request information on a nearby station and/or bus stop available for transfer from a bus stop.

An apparatus for providing transportation information in accordance with another embodiment of the invention comprises a decoder for extracting information on a bus stop and information on a nearby station and/or bus stop available for transfer from the bus stop from a received signal; and a control unit, responsive to the user's request, for outputting the extracted information via an output unit. When providing information on a bus stop via the output unit, the control unit can provide a button having a function of requesting information on a nearby station and/or bus stop available for transfer from a bus stop.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The accompanying drawings, which are included to provide a further understanding of the invention, illustrate the preferred embodiments of the invention, and together with the description, serve to explain the principles of the present invention. In the drawings:

FIG. 3 illustrates an example of the syntax of the message management container shown in FIG. 2;

FIG. 4 illustrates an example of the syntax of the component constituting the application status container according to the message structure shown in FIG. 2;

FIG. 5 illustrates an exemplary format of the TPEG message according to one embodiment of the invention with focus on the application status container;

FIGS. 6A through 6E illustrate examples of the syntaxes of major elements of the format shown in FIG. 5;

FIGS. 9A through 9D illustrate examples of the syntaxes of major elements of the format shown in FIG. 8;

FIG. 10 illustrates an example of a schematic diagram of a terminal for receiving the public transportation information provided by a transportation information providing server according to an embodiment of the present invention;

FIGS. 11A through 11C illustrate examples of the way the public transportation information received according to the formats shown in FIG. 5 and/or FIG. 8 is stored in the terminal shown in FIG. 10 according to an embodiment of the present invention;

DETAILED DESCRIPTION OF THE PREFERRED EMBODIMENTS

In order that the invention may be fully understood, preferred embodiments thereof will now be described with reference to the accompanying drawings.

Figure 1:
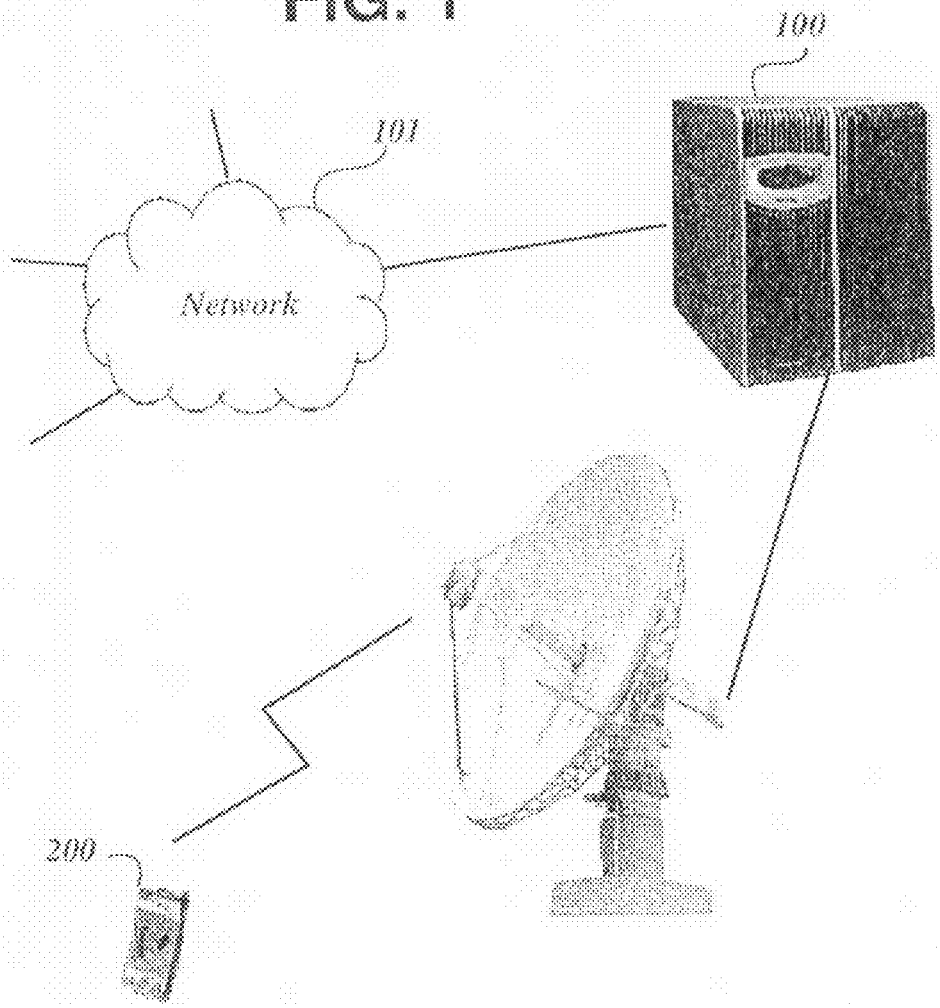
FIG. 1 illustrates a brief schematic diagram of a network through which public transportation information is provided in accordance with an embodiment of the present invention.

FIG. 1 is a brief schematic diagram of a network through which public transportation information (e.g., bus service information) is provided in accordance with the present invention. A transportation information providing server (or other device) 100, which collects public transportation information from several sources such as operator input or other servers via a network 101, reconstructs and transmits wirelessly the public transportation information so that users of a portable public transportation information receiving terminal 200 (hereinafter referred to as the terminal) can receive the information.

The public transportation means (e.g., bus, train, metro, subway, etc.) on which the public transportation information is provided transmits information on the position thereof to a bus transportation information collecting securer (not illustrated) or other types of servers via a different network on a regular basis. The bus transportation information collecting server transmits the collected information to the transportation information providing server 100. It is possible that the transportation information providing server 100 also plays the role of the bus information collecting server. Although the bus information is discussed herein, the present invention is not limited thereto, and can be applied to other transportation means, e.g., train, metro, subway, etc.

Figure 2:
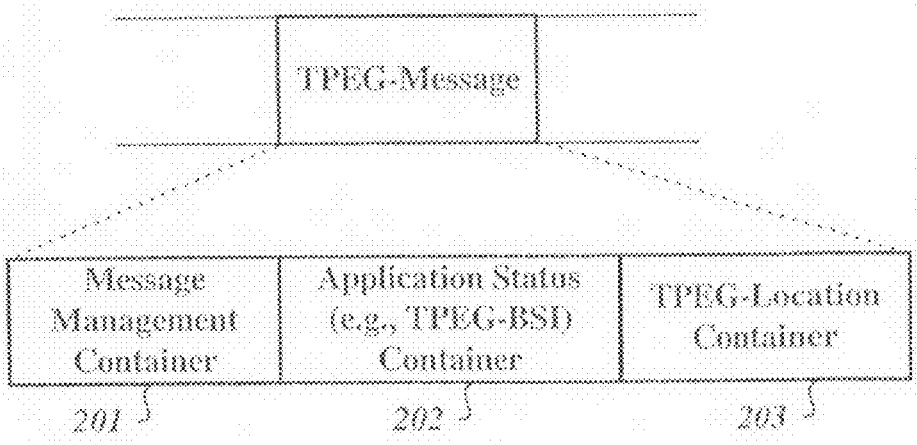
FIG. 2 illustrates an example of the structure of a TPEG message containing public transportation information according to the present invention.

The public transportation information wirelessly transmitted by the transportation information providing server 100 is a sequence of TPEG (Transport Protocol Expert Group) messages. As shown in FIG. 2, a TPEG message contained in the sequence preferably comprises a message management container 201, an application status container 202, and a TPEG location container 203. In the present invention, bus service information (or other public transportation service information) is delivered by the application status container 202 and thus the application status container 202 is also referred to as the TPEG-BSI (bus service information) container. The selection of the name of the application status container is irrelevant to the spirit of the invention and therefore the application status container may be named differently. Likewise, other components of the message may be named differently.

The transportation information providing server 400 records or includes transportation information to transmit in the message management container 201 according the syntax shown in FIG. 3. As shown in FIG. 3, the recorded information includes a message ID, the version number of the provided service, message creation time, etc. The information may also include the current date and time.

The application status container 202 and TPEG location container 203 comprise at least one BSI component according to the syntax shown in FIG. 4. The message management container 201 includes a selector 301 for indicating if the following data is component data for BSI.

The transportation information providing server 100 writes an identifier indicating the component type in each component. In one embodiment of the invention, components carrying route-based bus service information, components carrying bus-stop-based bus service information, and components of the TPEG location container 203 are assigned identifiers of 0x80, 0x81, and 0xB0, respectively.

As mentioned above the transportation information providing server 100 may construct and provide either bus-route-based bus service information or bus-stop-based bus service information.

A preferred embodiment of the present invention that constructs components of public transportation information based on bus route (or bus line) will now be described in detail.

In the following description, a notation of the form locNN_ii wherein NN and ii are numbers is used. The locNN_ii means the ii value of a table named locNN, one of many loc tables pre-stored in the terminal 200 or one of many hard-coded loc tables, and both of the transportation information providing server 100 and the terminal 200 know the meaning thereof. Another notation of the form bsiN_ii can be interpreted in the same manner but it represents a bsi table. Likewise, both of the transportation information providing server 100 and the terminal 200 know the meaning of bsiNN_ii. The preferred embodiments of the present invention use some of the tables defined in the TPEG. But the present invention is not confined to a specific standard and tables newly defined between the public transportation information sources and terminal can be used.

Referring to FIG. 5, the transportation information providing server 100 stores one or more BSI components 501 carrying bus route information, which have an identifier of 0x80 and follow the syntax shown in FIG. 6A, in the application status container 202. The application status container 202 may also deliver BSI components having an identifier of 0x81, which will be described later. The bus route information 501 comprises a bus route ID 501*a*, a bus service name 501*b*, and a bus route descriptor 511. The bus route ID 501*a* is preferably a unique number for identifying the bus route. The bus service name 501*b* is preferably the bus number or information comprising the bus number and bus destination. Alternatively, the bus set-vice name 501*b* may be the name of the bus service company. The bus route descriptor 511 comprises sequential section information 522 (bus route description component with an ID of 0x01) for describing the bus route and bus location information 521 (bus route description component with an ID of 0x00) for describing the current position of each bus running on the route. The bus location information 521, which has the syntax shown in FIG. 6B, includes a current bus position 531 (bus location component with an ID of 0x00) for each bus. The current bus position 531, which has the syntax shown in FIG. 6C, comprises a bus ID 531*a* and a bus position 531*b*, which has the hierarchical structure shown in FIG. 7A and indicates the current position of the bus.

Figure 7A:
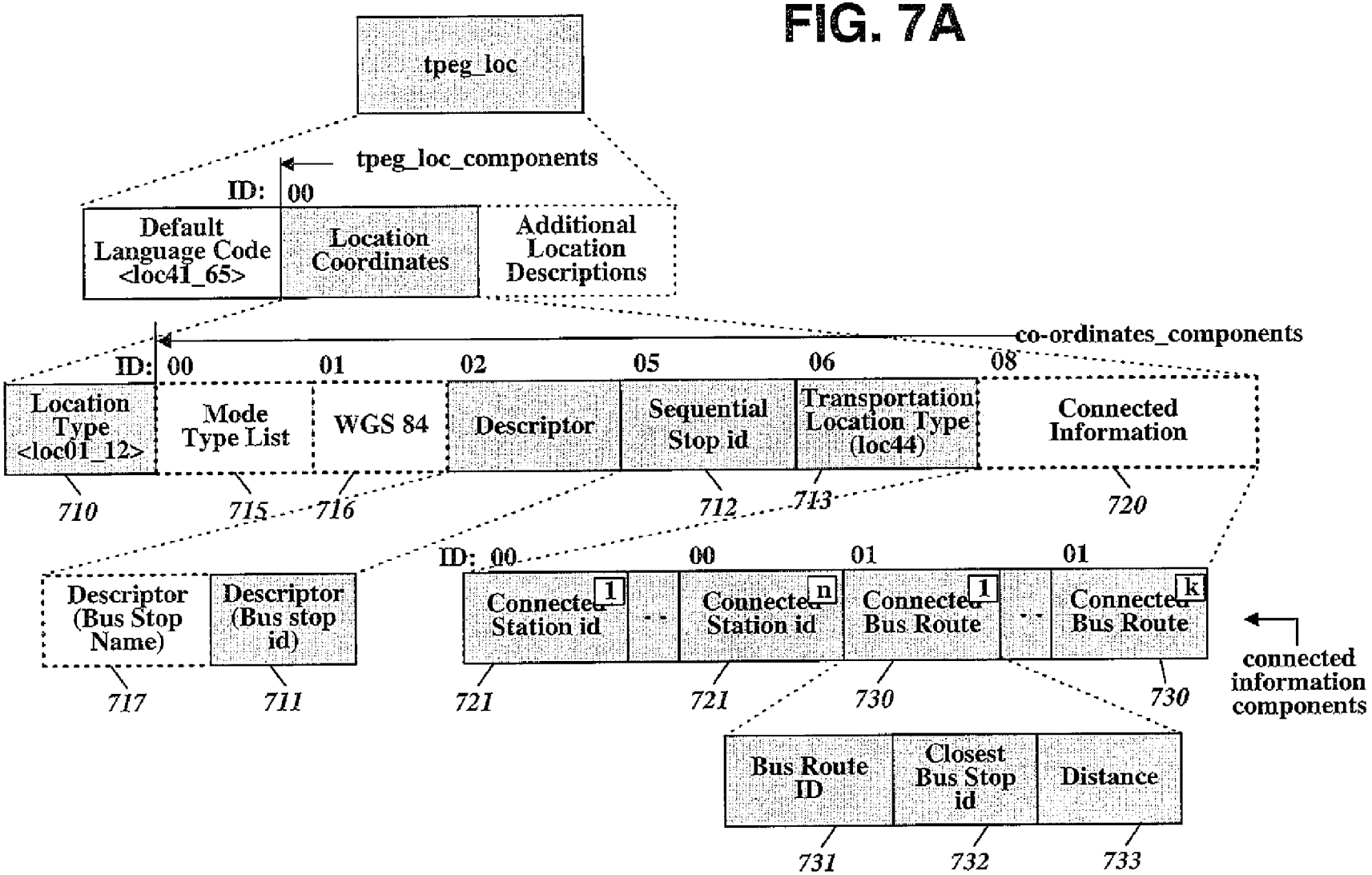
FIGS. 7A and 7B illustrate exemplary structures of position information delivered by a TPEG location container according to the present invention.

As shown in FIG. 7A, the bus position 531*b* comprises a location type 710, a descriptor bus stop id 711, a sequential stop id 712, and transportation location type 713. The location type 710 has a value of loc01_12 indicating that the position is represented by a bus stop. The descriptor bus stop id 711 is a number or code uniquely assigned to each of the bus stops located within a service area. The sequential stop id 712 is a number sequentially assigned to each of the bus stops located along a bus route. The transportation location type 713 indicates whether the current bus position is before reaching the reference bus stop, i.e., the bus stop indicated by the descriptor bus stop id 711 or sequential stop id 712, past the reference bus stop, or at the reference bus stop. The transportation location type 713 of a value of 1 indicates that the bus is now located between the reference bus stop and the previous bus stop. The transportation location type 713 of a value of 2 indicates that the bus is now located at the bus stop. The transportation location type 713 of a value of 3 indicates that the bus is now located between the reference bus stop and the next bus stop. If the bus position is unknown, the value of the transportation location type 713 is set to 0. Other values or representations can also be used for the various fields.

The bus position 531*b* may optionally include a mode type list 715, WGS84 coordinates 716, and a descriptor bus stop name 717 but does not include bus stop connected information 720 shown in FIG. 7A. The mode type list 715 stores information indicative of the transportation mode. If the mode type list 715 is included in the bus position 531*b*, a value (e.g., 6) indicating that the transportation mode is a bus is stored in the mode type list 715.

Returning to FIG. 5, the sequential section information 522, which has the syntax shown in FIG. 6D, includes a section attribute 532 (sequential section component with an ID of 0x00) for each section between two sequential bus stops. The section attribute 532, which has the syntax shown in FIG. 6E, includes the distance of the section 532*b*, the travel time in the section 532*a*, and information on the starting bus stop of the section (tpeg_loc) 532*c* having the syntax shown in FIG. 7A. Because the information on the starting bus stop 532*c* is information on a fixed bus stop, the value of the transportation location type is set to 2 indicating the position of a bus stop. Unlike the bus position 531*b*, the information on the starting bus stop 532*c* further includes bus stop connected information 720 shown in FIG. 7A.

The bus stop connected information 720 comprises at least one connected subway station id 721 and at least one connected bus route 730. The connected subway station id 721 is the id of a subway station accessible on foot for transfer. As shown in FIG. 7A more than one connected subway station ids can be contained in the bus stop connected information 720. The connected bus route 730 delivers information on a nearby bus stop located on a bus route that does not pass the bus stop indicated by the descriptor bus stop id 711 or sequential stop id 712. Information on each route passing a specific bus stop is delivered by bus stop based public transportation information components to be described later. In an example of FIG. 7C, if the reference bus stop pointed to by the descriptor bus stop id 711 or sequential stop id 712 is bus stop 790 on line A, information on bus stop 791, which is the nearest bus stop on line C, is delivered by the connected bus route 730. Information on each route passing bus stop 790 is delivered by bus-stop-based public transportation information components (BSI components with an ID of 0x81), which will be described later.

The connected bus route 730 includes information on a bus route ID 731, a closest bus stop id 732, the distance 733 between the bus stop indicated by the closest bus stop id 731 and the bus stop indicated by the descriptor bus stop id 711 or sequential stop id 712.

The connected subway station id 721 may be a number, code, or string that uniquely identifies a subway station. The bus stop connected information 720 may also include information on the distance between the reference bus stop, i.e., the bus stop indicated by the descriptor bus stop id 711 or sequential stop id 712 and the subway station indicated by the connected subway station id 721. The bus stop connected information 720 stores information on subway stations and/or bus stops on different bus routes accessible on foot (e.g., located within a radius of 500 m).

Accordingly, the present invention transmits information on a bus stop together with information on nearby subway stations and/or the nearest bus stop on bus routes that do not pass the bus stop and thus helps the user make a decision on whether to use the subway or to take another bus at the nearest bus stop to reach the destination. The information on the nearest bus stop located on different bus lines can be conveniently used when there is no bus service to the user's destination at the current bus stop.

The transportation information providing server 100 stores information on the service area in the TPEG location container 203. The TPEG location container 203 delivers the information on the service area also using the syntax shown in FIG. 7B.

Figure 7B:
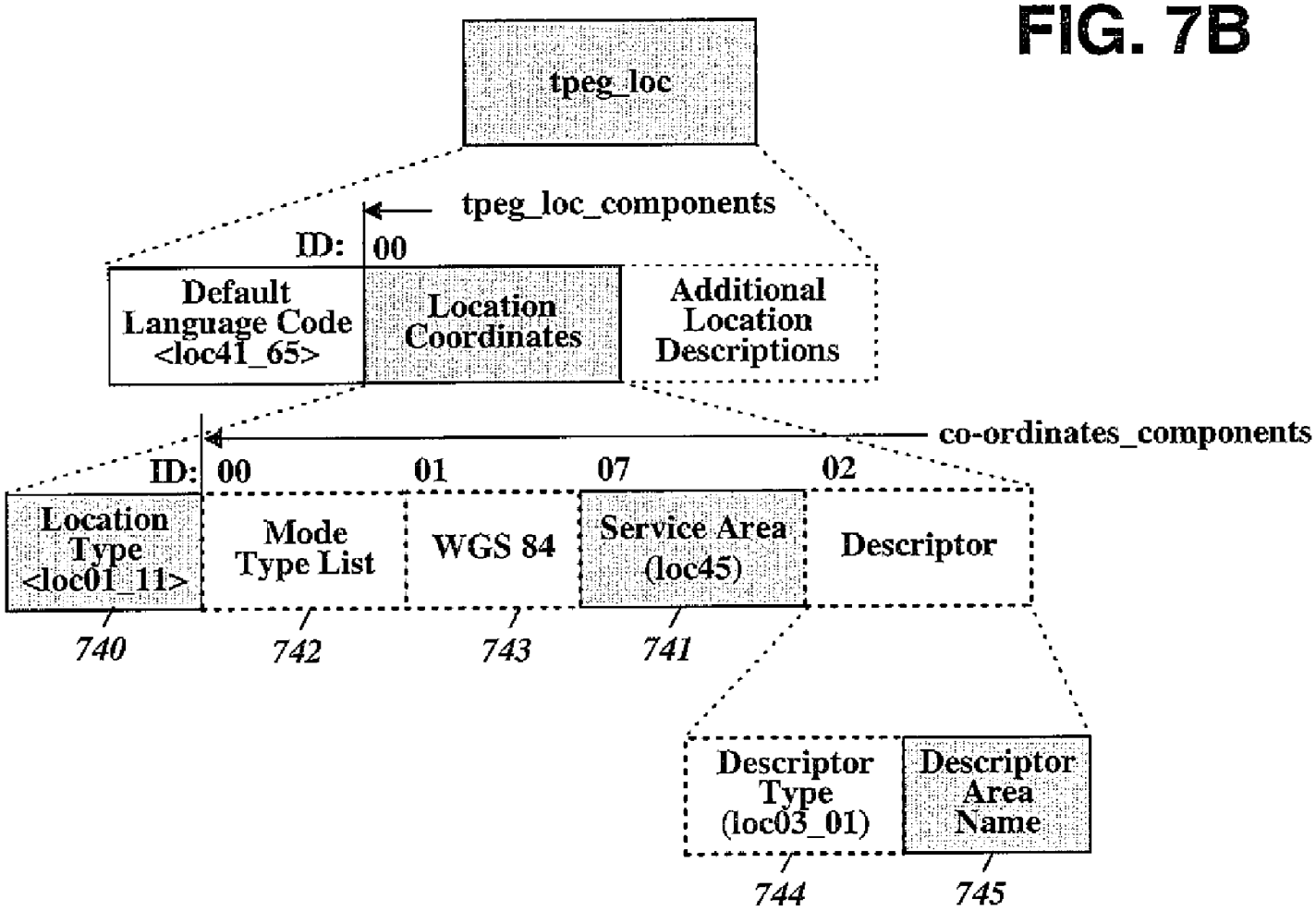
Figure 7C:
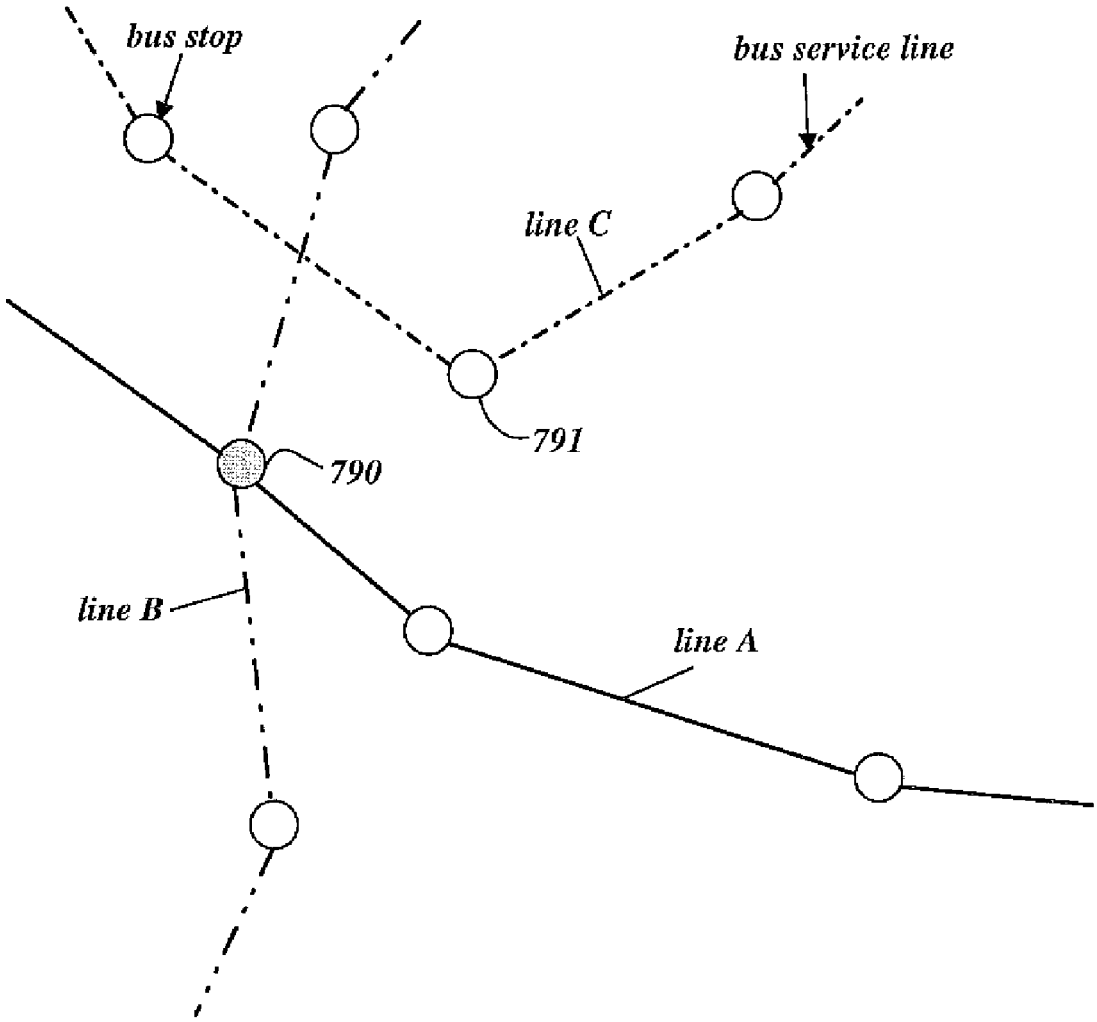
FIG. 7C illustrates an exemplary schematic diagram showing bus stops and bus service lines according to the present invention.

As shown in FIG. 7B, the TPEG location container 203 containing information on the service area includes a location type 740 having a value of loc01_11 indicating that the location reference is the service area and service area information 741. The service area information 741 stores a value assigned to each service area. If the service area is Seoul, for example, the service area information 741 has the value of 1 (loc45_1).

The TPEG location container 203 may optionally include a mode type list 742, WGS84 coordinates 743, and/or a descriptor area name 745. The descriptor area name 745 stores text information indicative of the service area. If the text information is included, loc03_01 indicating the description of the service area is written in the location type 740. The mode type list 742 stores information indicative of the transportation mode. If the mode type list 742 is included, a value indicating that the transportation mode is a bus, (e.g., 6) is stored in the mode type list 742.

The transportation information providing server 100 constructs a TPEG message having containers following the syntaxes shown in FIGS. 3, 4, 6A through 6E, 7A, and 7B according to the format shown in FIG. 5 as discussed above and transmits the constructed TPEG message to terminals wirelessly.

The TPEG message shown in FIG. 5 assumes only one bus route. If the number of public bus service lines in a city is P and information on one bus line (e.g., the location of bus stops, or current bus position) is delivered by one bus route information container 501, the service information on every bus service line in the city can be provided by P bus route information containers.

A preferred embodiment of the present invention that constructs the components of public transportation information based on bus stops will now be described in detail.

Figure 8:
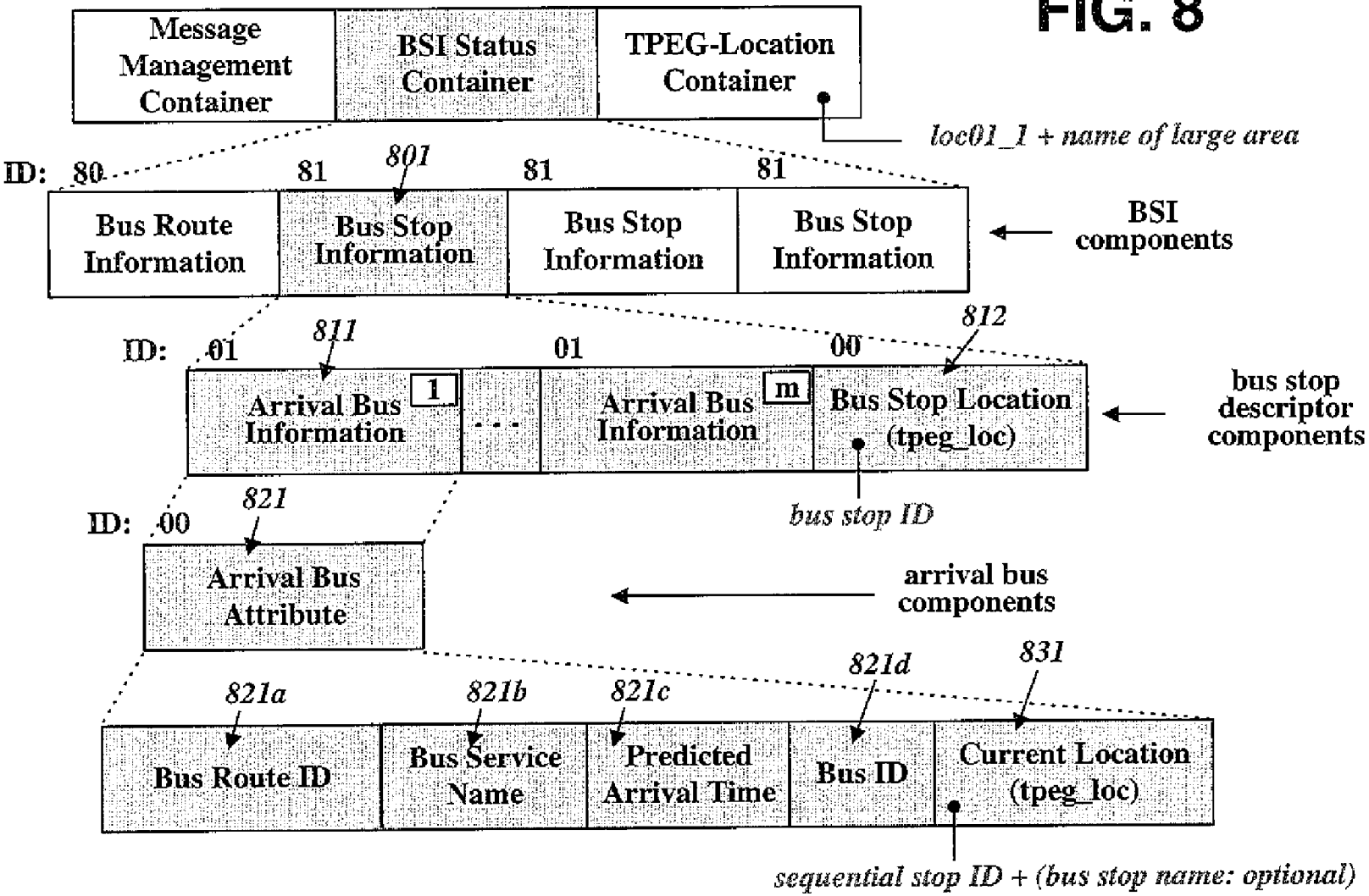
FIG. 8 illustrates an exemplary format of the TPEG message according to another embodiment of the invention with focus on the application status container.

The transportation information providing server 100 stores BSI components carrying bus stop information 801, which have an identifier of 0x81 and follow the syntax shown in FIG. 9A, in the application status container 202, as shown in FIG. 8. As mentioned earlier, the application status container 202 may also deliver BSI components having an identifier of 0x80. The bus stop information 801 comprises a bus stop location 812 and arrival bus information 811. The bus stop location 812, which is a bus stop description component having an ID of 0x00, contains information on the position of the bus stop on which the bus stop information is created. Arrival bus information 811, which is a bus stop description component having an ID of 0x01, contains information on each bus route passing the bus stop indicated by the bus stop location 812. The bus stop location 812 has the syntax shown in FIG. 9B.

The bus stop location 812 contains information on the bus stop location using the hierarchical structure shown in FIG. 7A.

As shown in FIG. 7A, the bus stop location 812 comprises a location type 710, a descriptor bus stop id 711, a sequential stop id 712, transportation location type 713, and bus stop connected information 720. The location type 710 has a value (e.g., loc01_12) indicating that the position references a bus stop. The transportation location type 713 indicates whether the current position is before reaching the reference bus stop, i.e., the bus stop indicated by the descriptor bus stop id 711 or sequential stop id 712, past the reference bus stop, or at the reference bus stop. The value of the transportation location type 713 is set to 2 because the current position is the reference bus stop. Because the structure of the bus stop connected information 720 contained in the bus stop location 812 is the same as that of the information on the starting bus stop 532*c* described in the previous embodiments for providing route-based public transportation information, the structure of the bus stop connected information 720 is not described here.

The bus stop location 812 may optionally include a mode type list 715, WGS84 coordinates 716, and a descriptor bus stop name 717. The mode type list 715 stores information indicative of the transportation mode. If the mode type list 715 is included in the bus stop location 812, a value (e.g., 6) indicating that the transportation mode is a bus is stored in the mode type list 715.

The arrival bus information 811, which has the syntax shown in FIG. 9C, includes an arrival bus attribute 821 (arrival bus component with an ID of 0x00) storing information on a bus route passing the target bus stop. The arrival bus attribute 821, which has the syntax shown in FIG. 9D, comprises a bus route ID 821*a*, a bus service name 821*b*, predicted arrival time 821*c*, and a bus ID 821*d*. The bus route ID 821*a* is an ID assigned to the bus route passing the bus stop for identifying the bus route. The bus service name 821*b* can be the bus number, the name of the bus service company, or coded information describing the name of the bus service company. The predicted arrival time 821*c* is the predicted arrival time of an incoming bus predicted based on traffic congestions and can be specified in terms of increments from a scheduled arrival time. The bus ID 821*d* is the ID of the incoming bus scheduled to arrive at the predicted arrival time. Each bus is assigned a unique bus ID in such a way that a unique ID is assigned sequentially to each of the buses running on a bus route or is assigned to each of the buses running in a service area.

The arrival bus attribute 821 also includes a current location 831, which has the hierarchical structure shown in FIG. 7A and stores information on the current location of a bus closest to the bus stop indicated by the bus stop location 812.

As shown in FIGS. 7A and 8, the current location 831 comprises a location type 710, a descriptor bus stop id 711, a sequential stop id 712, and transportation location type 713 but does not include bus stop connected information 720. The transportation location type 713 indicates whether the current position is before reaching the reference bus stop, i.e., the bus stop indicated by the descriptor bus stop id 711 or sequential stop id 712, past the reference bus stop, or at the reference bus stop. The transportation location type 713 of a value of 1 indicates that the bus is now located between the reference bus stop and the previous bus stop. The transportation location type 713 of a value of 2 indicates that the bus is now located at the bus stop. The transportation location type 713 of a value of 3 indicates that the bus is now located between the reference bus stop and the next bus stop. If the bus position is unknown, the value of the transportation location type 713 is set to 0. Other values or representations may be used.

The current location 831 may optionally include a mode type list 715, WGS84 coordinates 716, and a descriptor bus stop name 717. The mode type list 715 stores information indicative of the transportation mode. If the mode type list 715 is included in the current location 831, a value (e.g., 6) indicating that the transportation mode is a bus is stored in the mode type list 715.

The transportation information providing server 100 constructs a TPEG message having containers following the syntaxes shown in FIGS. 3, 4, 7A, 7B, and 9A through 9D according to the format shown in FIG. 8 discussed above and transmits the constructed TPEG message to terminals wirelessly.

The TPEG message shown in FIG. 8 assumes only one bus stop. If the number of bus stops in a city in which public transportation information is provided is Q and arrival time information at one bus stop is delivered by one bus stop information container 801, the arrival time information for every bus stop in the city can be provided by Q bus arrival time containers.

If the terminal 200 does not have the coordinates information for each bus stop, each of the components delivering information on the current bus location or bus stop location (541, 542, 812, 831) includes a component for storing WGS84 coordinates, which has an ID of 0x01.

The terminal 200 shown in FIG. 1 for receiving public transportation information in accordance with the preferred embodiments may store basic information related to each bus stop ID and basic information related to each bus route ID in addition to the aforementioned loc tables and bsi tables. The basic information related to each bus stop ID can include a bus stop ID, a bus stop type, and a bus stop name. The basic information related to each bus route ID can include a route name, a route type, IDs of the start and end bus stops, the number of bus stops, the arrival time of the first and last bus service at each bus stop, and the route shape information. The route shape information includes feature points of the route and the ID or WGS84 coordinates thereof, the feature points being selected such that the shape of the route can be shown on a VGA or QVGA display.

Under the condition that the terminal 200 does not have the basic information within it, the transportation information providing server 100 may provide information which is not provided by the aforementioned real time bus information service to the terminal 200. For example, the transportation information providing server 100 may provide information on the arrival time of the first and last bus service at each bus stop and the shape of each bus route.

FIG. 10 shows an example of a schematic diagram of the terminal 200 shown in FIG. 1 for receiving the public transportation information wirelessly provided by the transportation information providing server 100 according to the present invention. The terminal 200 comprises a tuner 1, a demodulator 2, a TPEG-BSI decoder 3, a GPS module 8, a memory (or other storage unit) 4, an input device 9, a control engine 5, an LCD panel (or other display unit) 7, and an LCD (display) driver 6. The terminal 200 can include other components, and all components of the terminal 200 are operatively coupled and configured.

The tuner 1 tunes to the frequency band in which the public transportation information is delivered and outputs modulated public transportation information. The demodulator 2 outputs a public transportation information signal by demodulating the modulated public transportation information. The TPEG-BSI decoder 3 decodes the demodulated public transportation information signal. The GPS module 8 obtains the latitude, longitude, and altitude of the current position based on satellite signals obtained from a plurality of low orbit satellites. The memory 4 stores the decoded public transportation information. The control engine 5 controls the display output based on the user input, the current position, and the obtained public transportation information. The LCD driver 6 outputs signals according to text or graphics for driving the LCD panel 7. The input device 9 may be an interface installed on the LCD panel 7 such as a touch screen. The terminal 200 may further comprise a non-volatile memory storing an electronic map as well as the memory 4. The terminal 200 can be various types of mobile terminals such as a mobile phone, a PDA, a smart phone, a computer notebook, etc., and can be part of a device/system.

The tuner 1 tunes to the signal transmitted by the transportation information providing server 100 and the demodulator 2 demodulates the modulated signal received from the tuner 1. The TPEG-BSI decoder 3 extracts the public transportation information messages constructed as shown in FIGS. 2 through 5, 6A through 6E, 7A, and 7B and/or FIGS. 2, 3, 7A, 7B, 8, and 9A through 9D from the demodulated signal, stores the extracted TPEG messages temporarily, interprets the stored TPEG messages, and transmits information and/or control data obtained from the interpreted TPEG messages to the control engine 5.

The TPEG-BSI decoder 3 determines if the received public transportation information can be decoded based on the information contained in the message management container of each of the extracted TPEG messages and decodes the following data based on the value of the selector.

The control engine 5 constructs a route-based information table as shown in FIG. 11A in the memory 4 if the data received from the TPEG-BSI decoder 3 is route-based information, i.e., information decoded from the application status container with an ID of 0x80. If the data received from the TPEG-BSI decoder 3 is bus-stop-based information, i.e., information decoded from the application status container with an ID of 0x81, the control engine 5 constructs a bus-stop-based information table as shown in FIG. 11B in the memory 4. FIGS. 11A and 11B are simple examples and therefore the tables may further include additional information not illustrated in the figures (e.g., a bus service name, a bus ID, distance of a section, or additional information transmitted from the transportation information providing server 100). The information on nearby subway stations or bus stops accessible for transfer is also constructed by the control engine 5 for each bus stop as another table as shown in FIG. 11C.

In FIGS. 11A, 11B, and 11C, the bus stop name is used as the bus stop ID but this is only an example for explanation and the code assigned to each bus stop, i.e., bus stop ID or sequential stop ID can be actually stored. When showing the information to the user, the terminal 200 reads the bus stop name stored in a memory installed in the terminal 200 or the name associated with the ID number received from the transportation information providing server 100 and displays the name.

Instead of constructing separate information tables shown in FIGS. 11A, 11B, and 11C, the control engine 5 may construct an integrated information table for storing the route based information, bus-stop based information, and connected information. The public transportation information stored as shown in FIGS. 11A, 11B, and 11C is updated each time new information is received from the transportation information providing server 100.

Instead of storing all data received from the TPEG BSI decoder 3, the control engine 5 may selectively store only data regarding bus stops near the current position identified by the GPS module 8 (e.g., bus stops located within a circle of a radius of 1 Km). The terminal 200 is likely to have a limitation in the memory size and the scheme of storing information selectively improves the efficiency of memory use.

Figure 12:
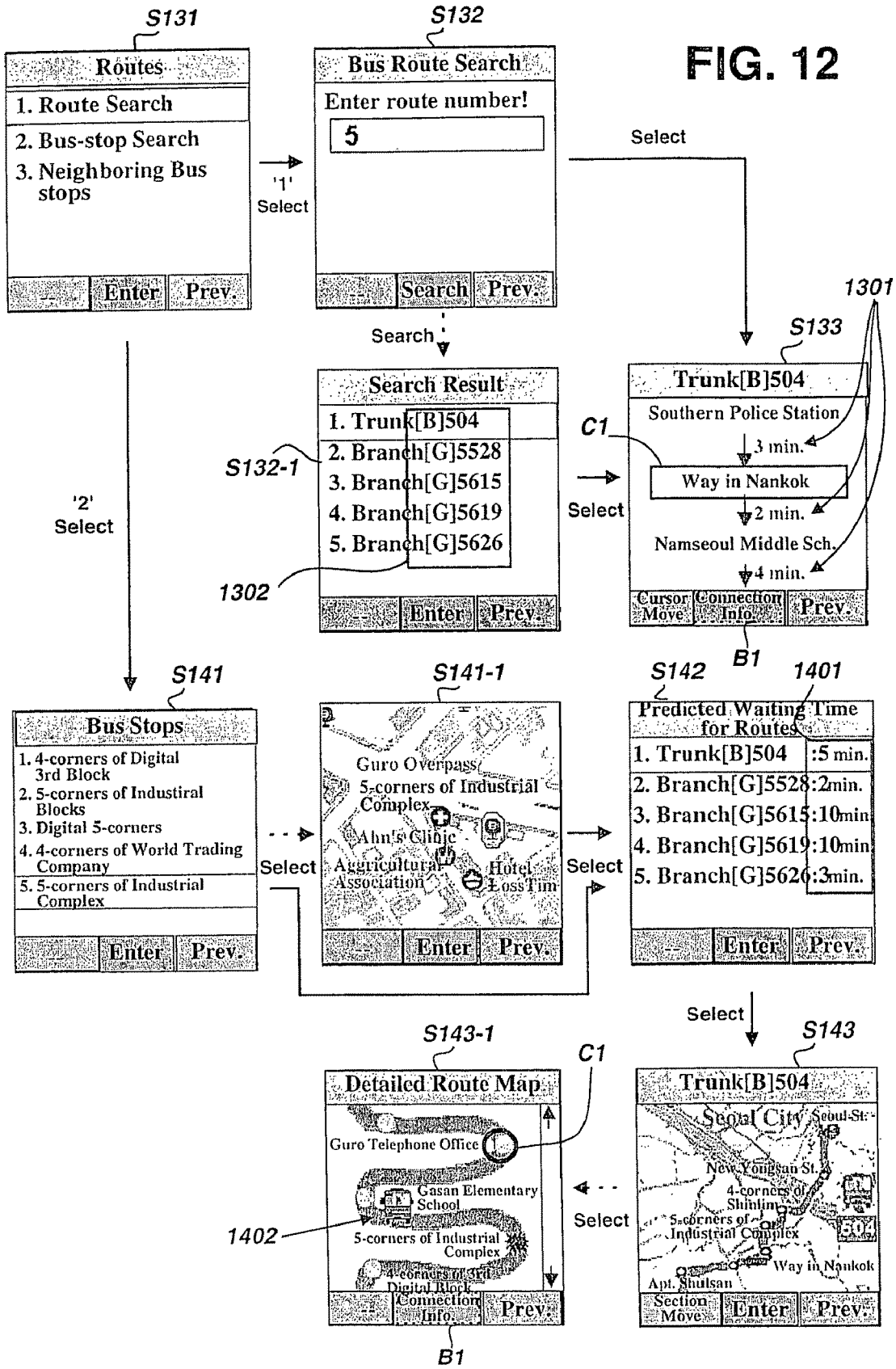
FIG. 12 illustrates exemplary screen images displaying information on bus stops and/or on bus routes in response to a user's request for public transportation information according to the present invention.

FIG. 12 illustrates examples of displaying various public transportation information to a user according to the present invention. If the user requests public transportation information via the input device 9 while the received public transportation information is stored in the aforementioned manner, the terminal 200 displays a menu for allowing the user to select available public transportation information on the LCD panel 7 as shown in FIG. 12 (S131). If the user selects a bus route search from the displayed menu, the terminal 200 provides an input window through which the user can input a required route number. If a bus route is inputted (S132), the control engine 5 searches the memory 4 for information on each of the bus stops located on the selected bus route stored as shown in FIG. 11A and displays the name of each of the bus stops together with the route ID on the screen (S133). When displaying the route ID, the terminal 200 may perform an additional operation of appending symbols or text to the route ID for helping the user notice the route ID more easily. For example, if the route ID is B504, text 'Trunk []' is appended to the route ID and 'Trunk[B]504' is displayed on the screen. The terms of 'Branch' and 'Intercity' may be displayed respectively in connection with alphabets 'G' and 'R' preceding the line number instead of those alphabets. The control engine 5 reads traveling time between bus stops from the information table shown in FIG. 11A and displays the traveling time between the bus stop names (1301) on the screen of the terminal.

If the user inputs a part of route identification information (e.g., a part of a route ID), there may be multiple route IDs part of which matches the inputted information. In this case, the control engine 5 searches the route-based information table stored as shown in FIG. 11A for all route IDs part of which matches the user input and enumerates the entire found route IDs 1302 with optionally appending symbols or text (S132-1). If one ID is selected from among the enumerated IDs, the terminal 200 displays information on bus stops belonging to the selected route and traveling time between two consecutive bus stops (S133).

If the user selects a search for bus stops instead of the search for bus routes from the public transportation information related menu (S131), the control engine 5 searches the memory 4 for bus stops located within a predefined radius (e.g., 1 Km) from the current position obtained by the GPS module 8 and displays the list of the found bus stops on the LCD panel 7 (S141).

If the user selects one bus stop form the displayed list via the input device 9, the control engine 5 obtains the predicted arrival time of an incoming bus running on each bus route passing the selected bus stop, which is stored in the memory 4 as shown in FIG. 11B, and enumerates the predicted arrival time along with the ID of each bus route (S142). Other types of stored information on each bus route passing the bus stop (the current position of a next bus) may be displayed in response to other selection keys or a move key.

If the terminal 200 is equipped with a nonvolatile memory storing an electronic map and one bus stop is selected from the list of bus stops (S141), the terminal 200 reads a part of the electronic map around the selected bus stop and displays the part on the LCD panel 7 using the driver 6 (S141-1). In this case, the current location is marked with a specific graphic symbol and the selected bus stop is also marked with a graphic symbol and description information on the displayed electronic map. If "contirm" key is inputted while the electronic map around the selected bus stop is displayed, the information on bus routes passing the selected bus stop is displayed (S142).

If the user selects one bus route while the list of bus routes passing the selected bus stop is displayed (S142), the control engine 5 reads the route shape information and information on bus stops located on the bus route from the memory 4 and/or another memory and displays the information (S143), thereby allocating the user to determine if the bus route is headed for the user's destination. If the terminal 200 is equipped with the non volatile memory, the control engine 5 displays the shape of the bus route on the electronic map. If the user selects "detailed information" or "select (Enter)", the control engine 5 magnifies the displayed electronic map around the selected bus stop (S143-1). When displaying a part of a bus route in detail, the terminal 200 reads information on the current position of the next bus from the information table shown in FIG. 11B from the memory 4 and displays a specific icon (e.g., bus icon 1402) at the corresponding position on the displayed map, thereby allowing the user to easily notice the bus location visually.

When more than one bus stop or symbols indicating more than one bus stop are to be displayed on the LCD panel 7 in response to the user's request (S133 or S143-1), the control engine 5 provides a soft button B1 for the user so that the user can make a request for connection information related to a selected bus stop. The soft button (or menu item) B1 is either a mechanical key fixed in the input device 9 or a graphical symbol displayed on the LCD panel 7. If the soft button is a mechanical key, the function of the key can be changed selectively and information on the function of the key is displayed at a corresponding position on the LCD panel 7. If the soft button is a graphical symbol, the function of the key is displayed on the LCD panel 7 and selection of the key is also performed on the LCD panel 7, the LCD panel 7 being equipped with a touch screen. It is also possible to implement the button for selecting the related information as a fixed-function physical key on the input device 9.

Figure 13:
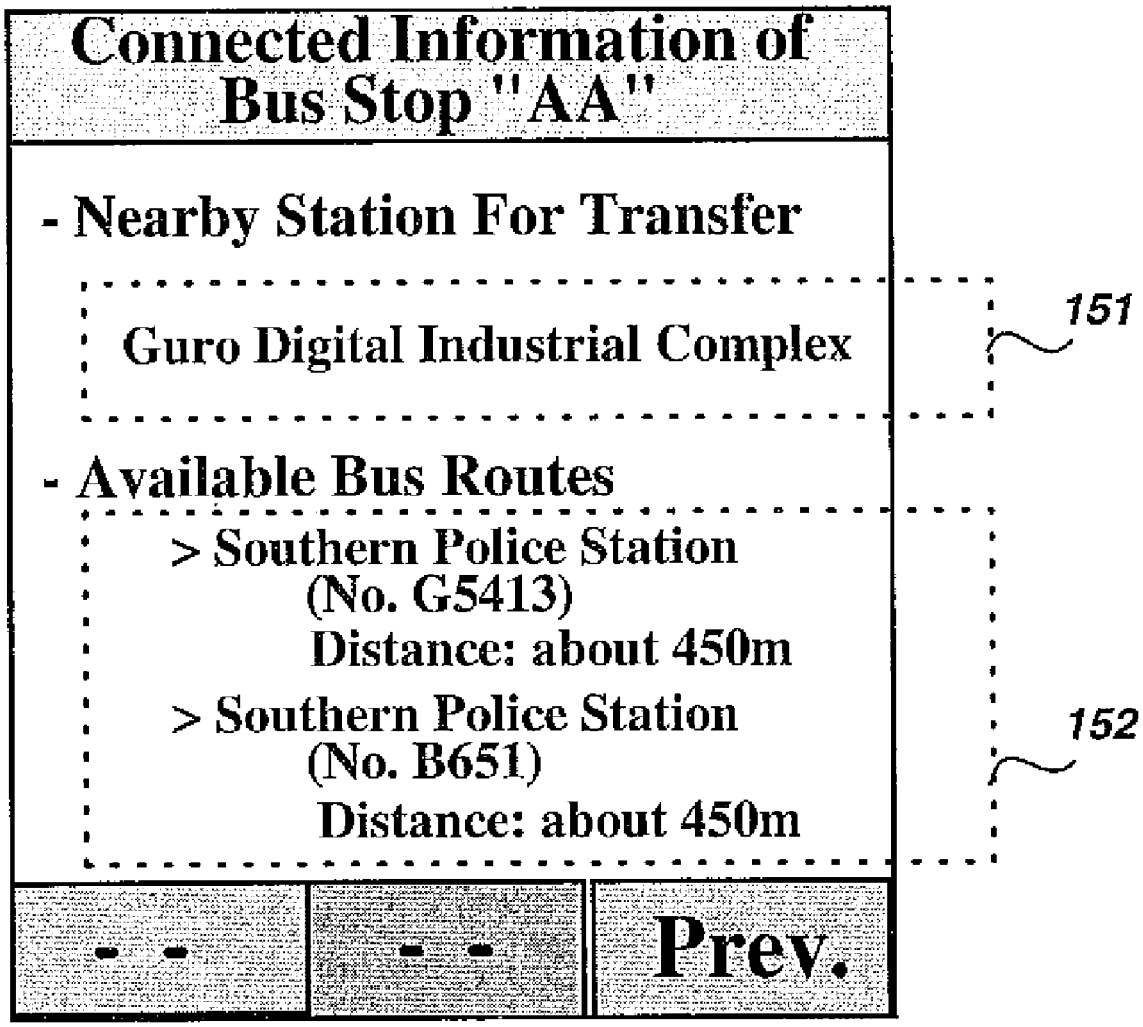
FIG. 13 illustrates an exemplary screen image displaying stored information associated with a selected bus stop according to the present invention.

If the user selects the soft button B1 for requesting connected information after moving a cursor C1 on the screen using "morve" key while the names of bus stops are displayed on the screen of the terminal 200 (S133) or a magnified view of the bus route is displayed together with the information on the bus stop (S143-1), the control engine 5 searches the list of information connected to each bus stop for the ID of the selected bus stop, reads the connected information stored in association with the bus stop ID as shown in FIG. 11C from the memory 4, and displays the obtained information on the screen as shown in FIG. 13. FIG. 13 is an example in which information related to bus stop AA is requested and displayed while bus stop related information is stored as shown in FIG. 11C. FIG. 13 shows the fact that bus route B5413 and B651 do not pass bus stop AA and the bus stop located on these bus routes and closest to bus stop AA is bus stop named "Southern Police Station" located at a distance of 450 m from bus stop "AA" (152) and the nearest subway station is "Guro Digital Industrial Complex" on subway line 2 (151).

In the preferred embodiments, the terminal 200 shown in FIG. 10 may be equipped with voice output means. In this case, when the user selects one bus stop and one route from among all bus routes passing the bus stop, the terminal may generate a voice output reporting the predicted arrival time of an incoming bus or when the user selects a bus route and a bus stop belonging to the bus route, the terminal may generate a voice output reporting the name of a bus stop at which an incoming bus is located. It is also possible to generate a voice output reporting other types of information. The voice output means has data required for voice synthesis.

At least one embodiment of the invention described thus far enables users to estimate how long it will be before next public transportation means is available, thereby allowing the users to do some useful things instead of simply waiting. The present invention promotes the use of public transportation by providing information on real time schedules available at any bus stop and nearby subway stations and/or bus stops located on other bus routes, thereby effectively reducing the use of private vehicles and the economical or social cost required for construction or curing environmental pollution.

While the invention has been disclosed with respect to a limited number of embodiments, those skilled in the art, having the benefit of this disclosure, will appreciate numerous modifications and variations therefrom. It is intended that all such modifications and variations fall within the spirit aid scope of the invention.

What is claimed is:

1. A method for providing transportation information, comprising:

creating, in a computing device, first information on each stop of a public transportation route, second information on an available route-transfer station and third information on an available route-transfer stop;

creating, in the computing device, fourth information on a current position of at least one vehicle in service on the public transportation route, fifth information on a vehicle arrival time for each public transportation route passing the available route-transfer station, and sixth information on a vehicle arrival time for each public transportation route passing the available route-transfer stop;

classifying, in the computing device, the first, second, third, fourth, fifth and sixth information into route-based information and vehicle-stop-based vehicle service information; and transmitting, from the computing device, the route-based information and the vehicle-stop-based vehicle service information via different containers in a sequence of messages formed in a hierarchical structure and including traffic information, wherein information on a nearby station and/or a nearby vehicle stop available for transfer from a bus stop is generated using both of the route-based information and the vehicle-stop-based information.

2. The method of claim 1, wherein the second information comprises:

information for identifying the available route-transfer station; and information for identifying a distance between the available route-transfer station and one of the stops.

3. The method of claim 1, wherein the third information comprises:

information for identifying the available route-transfer stop;

information for identifying a distance between the available route-transfer stop and another stop; and information for identifying public transportation routes passing the available route-transfer stop.

4. The method of claim 1, wherein the second information comprises:

information for identifying the available route-transfer station; and information for identifying a distance between the available route-transfer station and the available route-transfer stop.

5. The method of claim 1, wherein the third information comprises:

information for identifying the available route-transfer stop;

information for identifying a distance between the available route-transfer stop and the stop; and information for identifying a public transportation route passing the available route-transfer stop.

6. The method of claim 1, wherein the message formed in the hierarchical structure is a Transport Protocol Expert Group (TPEG) message.

7. A method for decoding transportation information, comprising:

extracting, from a received sequence of messages, transportation information classified into route-based information and vehicle-stop-based vehicle service information, the route-based information and the vehicle-stop based vehicle service information being carried by different containers of the sequence of messages formed in a hierarchical structure and including traffic information;

extracting, from the different containers, information on each stop of a public transportation route, information on an available route-transfer station, information on an available route-transfer stop, information on a current position of at least one vehicle in service on the public transportation route, information on a vehicle arrival time for each public transportation route passing the available route-transfer transfer station, and information on a vehicle arrival time for each public transportation route passing the available route-transfer stop; and outputting information on a nearby station and/or a nearby vehicle stop available for transfer from a vehicle stop upon receiving a selection input of the vehicle stop.

8. The method of claim 7, wherein the information on the station available for transfer comprises:

information for identifying the available route-transfer station; and information for identifying a distance between the available route-transfer station and one of the stops.

9. The method of claim 7, wherein the information on the stop available for transfer comprises:

information for identifying the available route-transfer stop;

information for identifying a distance between the available route-transfer stop and another stop; and information for identifying public transportation routes passing the available route-transfer stop.

10. The method of claim 7, wherein the information on the station available for transfer comprises:

information for identifying the available route-transfer station; and information for identifying a distance between the available route-transfer station and the available route-transfer stop.

11. The method of claim 7, wherein the information on the stop available for transfer comprises:

information for identifying the available route-transfer stop;

information for identifying a distance between the available route-transfer stop and the stop; and information for identifying a public transportation route passing the available route-transfer stop.

12. The method of claim 7, wherein the message information formed in the hierarchical structure is a Transport Protocol Expert Group (TPEG) message.

13. An apparatus for providing transportation information, comprising:

a demodulator;

a decoder;

an interface unit; and a controller operatively connected to the demodulator, the interface unit, and the decoder, the controller configured to extract, from a received sequence of messages, transportation information classified into route-based information and vehicle-stop-based vehicle service information, the route-based information and the vehicle-stop based vehicle service information being carried by different containers of the sequence of messages formed in a hierarchical structure and including traffic information, extract, from the different containers, information on each stop of a public transportation route, information on an available route-transfer station, information on an available route-transfer stop, information on a current position of at least one vehicle in service on the public transportation route, information on a vehicle arrival time for each public transportation route passing the available route-transfer transfer station, and information on a vehicle arrival time for each public transportation route passing the available route-transfer stop, and output information on a nearby station and/or a nearby vehicle stop available for transfer from a vehicle stop upon receiving an input from the interface unit.

14. The apparatus of claim 13, wherein the information on the station available for transfer comprises:

information for identifying the available route-transfer station; and information for identifying a distance between the available route-transfer station and one of the stops.

15. The apparatus of claim 13, wherein the information on the stop available for transfer comprises:

information for identifying the available route-transfer stop;

information for identifying a distance between the available route-transfer stop and another stop; and information for identifying public transportation routes passing the available route-transfer stop.

16. The apparatus of claim 13, wherein the interface unit is further configured to enable a user to request one of the information on each stop of a public transportation route, the information on an available route-transfer station, the information on an available route-transfer stop, the information on a current position of at least one vehicle in service on the public transportation route, the information on a vehicle arrival time for each public transportation route passing the available route-transfer transfer station, and the information on a vehicle arrival time for each public transportation route passing the available route-transfer stop.

17. The apparatus of claim 16, wherein the controller is configured to output, in response to a corresponding request from the user, the information on each stop of a public transportation route, the information on an available route-transfer station, the information on an available route-transfer stop, the information on a current position of at least one vehicle in service on the public transportation route, the information on a vehicle arrival time for each public transportation route passing the available route-transfer transfer station, and the information on a vehicle arrival time for each public transportation route passing the available route-transfer stop.

18. The apparatus of claim 16, wherein the interface unit is provided with an information request button configured to output, in response a corresponding request from the user, one of the information on each stop of a public transportation route, the information on an available route-transfer station, the information on an available route-transfer stop, the information on a current position of at least one vehicle in service on the public transportation route, the information on a vehicle arrival time for each public transportation route passing the available route-transfer transfer station, and the information on a vehicle arrival time for each public transportation route passing the available route-transfer stop.

19. The apparatus of claim 18, wherein the button comprises a physically fixed key and a text string indicating the function of the key.

20. The apparatus of claim 18, wherein the button comprises a touch area on the output unit and a text string indicating the function to be conducted when the touch area is touched, the text string being displayed on the touch area.

21. The apparatus of claim 13, wherein the message information formed in the hierarchical structure is a Transport Protocol Expert Group (TPEG) message.

* * * * *